United States Patent [19]

Wolf

[11] 4,149,338

[45] Apr. 17, 1979

[54] CHILD'S TOY AND GAME

[76] Inventor: Tobin Wolf, 285 Aycrigg Ave., Passaic, N.J. 07055

[21] Appl. No.: 766,491

[22] Filed: Feb. 7, 1977

[51] Int. Cl.[2] ..... A63H 29/16

[52] U.S. Cl. ..... 46/44; 46/88

[58] Field of Search ..... 46/87, 88, 90, 89, 44; 273/95 C; 272/27 B, 27 N

[56] References Cited

U.S. PATENT DOCUMENTS

| | | | |
|---|---|---|---|
| 857,097 | 6/1907 | McCormack | 276/95 C X |
| 1,098,303 | 5/1914 | Steiner et al. | 46/88 |
| 1,620,036 | 3/1927 | Pemberton | 46/87 |
| 3,025,634 | 3/1962 | Barricks | 46/88 |
| 3,740,896 | 6/1973 | Glass et al. | 46/206 |
| 3,769,955 | 11/1973 | Dugan et al. | 46/88 X |

*Primary Examiner*—Russell R. Kinsey
*Assistant Examiner*—Mickey Yu
*Attorney, Agent, or Firm*—Jay M. Cantor

[57] ABSTRACT

A child's toy which can also be used as a game wherein a simulated landscape includes a flower or mushroom mounted on a bellows thereon and a second flower mounted thereon. The landscape includes an air channel therewithin which includes an intake valve, a passage communicating with the bellows and an outlet valve communicating with the flower. The outlet valve region of the flower includes an elastomeric washer for receiving a balloon simulating a ladybug or the like, the balloon including a nozzle for substantially airtight communication with an insertion into the washer. The sides of the balloon rest on the sides of the flower interior so that, upon inflation of the balloon by reciprocation of the bellows in standard manner, air will come into the inlet valve to the bellows and air channel and, upon contraction of the bellows, pass through the air channel and through the outlet valve into the balloon. The balloon will thereby be inflated until the force of inflation causes expansion of the balloon wall and thereby exerts a sufficient outward force against the sides of the flower to pull the nozzle out of the washer. The inflated balloon will now release the air therefrom through the nozzle and the outlet air jet will cause the balloon to be ejected further from the flower and fly away in known manner.

The above described toy can be coverted into a game or utilized as a game by determining the number of depressions of the bellows required to make the balloon fly away or, alternatively by determining the distance from the toy that the balloon flies after release from the flowr.

10 Claims, 6 Drawing Figures

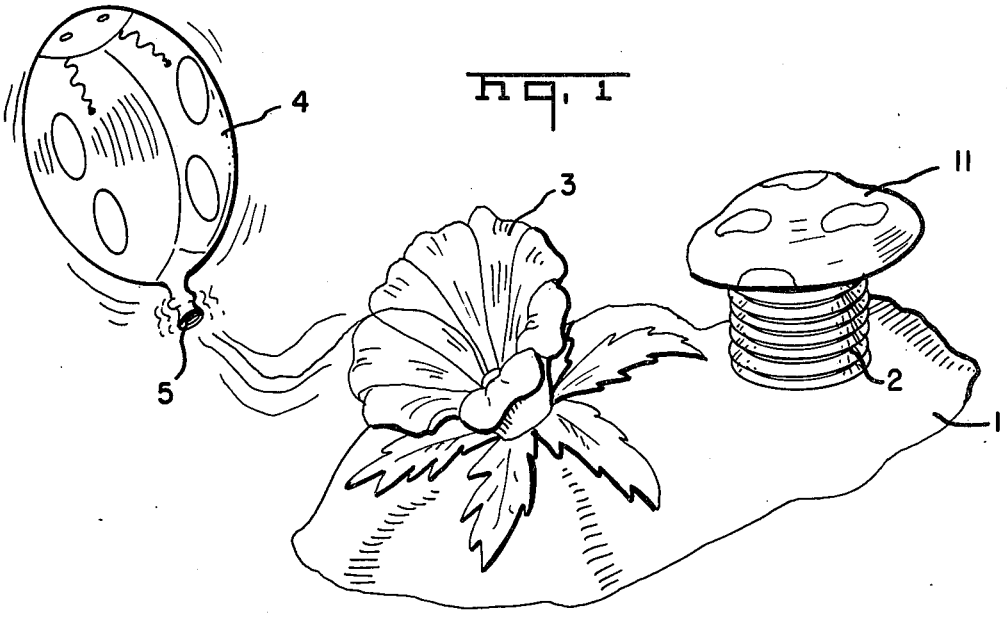
Fig. 1
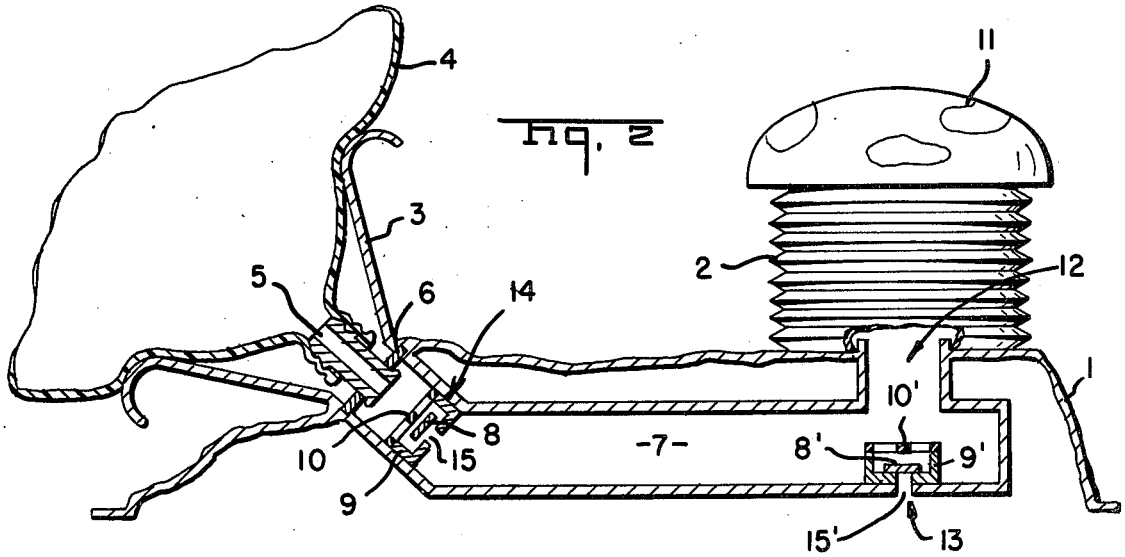
Fig. 2
Fig. 3
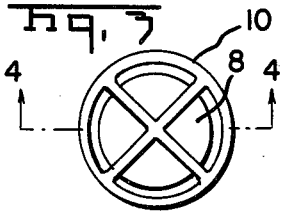
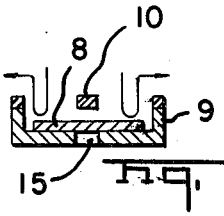
Fig. 4
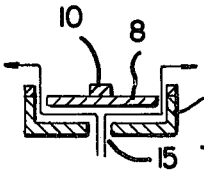
Fig. 5
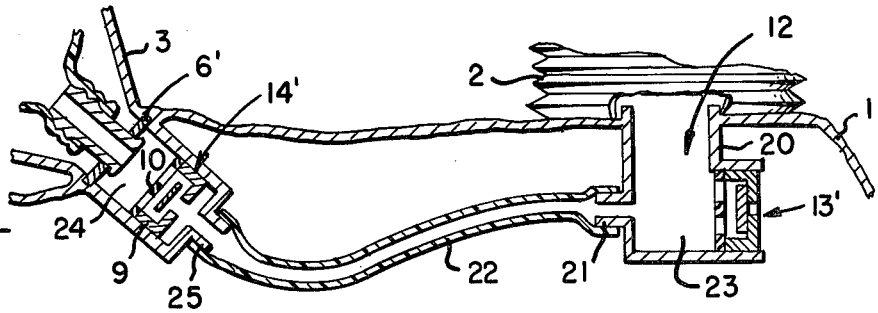
Fig. 6

CHILD'S TOY AND GAME

This invention relates to a simple and amusing toy and game for use by young children which requires no reading ability and can be used with a minimal amount of manipulative skill.

Although many simple child's grames and toys exist in the art, the art is always seeking new interesting toys and games for children which can be manufactured relatively inexpensively and yet be sufficiently strong to provide reasonably lengthy service. This is provided in accordance with the present invention.

In accordance with the present invention there is provided a child's toy which can also be used as a game wherein a simulated landscape includes a flower or mushroom mounted on a bellows thereon and a second flower mounted thereon. The landscape includes an air channel therewithin which includes an intake valve, a passage communicating with the bellows and an outlet valve communicating with the flower. The outlet valve region of the flower includes an elastomeric washer for receiving a balloon simulating a ladybug or the like, the balloon including a nozzle for substantially airtight communication with and insertion into the washer. The sides of the balloon rest on the sides of the flower interior so that, upon inflation of the balloon by reciprocation of the bellows in standard manner, air will come into the inlet valve to the bellows and air channel and, upon contraction of the bellows, pass through the air channel and through the outlet valve into the balloon. The balloon will thereby be inflated until the force of inflation causes expansion of the balloon wall and thereby exerts a sufficient outward force against the inside periphery of the flower to pull the nozzle out of the washer. The inflated balloon will now release the air therefrom through the nozzle and the outlet air jet will cause the balloon to be ejected further from the flower and fly away in known manner.

The above described toy can be converted into a game or utilized as a game by determining the number of depressions of the bellows required to make the balloon fly away or, alternatively by determining the distance from the toy that the balloon flies after release from the flower.

It is therefore an object of this invention to provide a child's toy and game which is relatively inexpensive to manufacture.

It is a further object of this invention to provide a child's toy and game which provides a releasable balloon fitting.

It is a yet further object of this invention to provide a child's game and toy which provides an easily releasable balloon fitting attachable into an inflation mechanism including inlet and outlet valves and a bellows.

The above objects and still further object of the invention will immediately become apparent to those skilled in the art after consideration of the following preferred embodiment thereof, which is provided by way of example and not by way of limitation wherein:

FIG. 1 is a three dimensional view of a toy and game in accordance with the present invention;

FIG. 2 is a cross-sectional view of the toy or game of the present invention with the balloon positioned for inflation;

FIG. 3 is a top view of the inlet and outlet valve mechanisms of FIG. 2;

FIG. 4 is a view taken along the line 4—4 of FIG. 3 with the valve closed;

FIG. 5 is a view taken along the line 4—4 of FIG. 3 with the valve open; and

FIG. 6 is a second embodiment of the air passage of FIG. 2.

Referring now to FIG. 1, there is shown the toy and game in accordance with the present invention which includes a base 1 in the form of a landscape having a piece of vegetation 11 thereon in the shape of a mushroom. The mushroom base 2 is in the form of a bellows for pumping air as will be explained hereinbelow. The base 1 also includes a flower 3 having a funnel-like structure. Also included is a balloon 4 in the shape of or decorated as a ladybug, the balloon having a nozzle 5 assembled to the air intake and outlet thereof, the nozzle serving to concentrate and direct the air escaping from the balloon (as will be described hereinbelow) in order to cause the balloon 4 to fly away by the jet action of the air escaping from the nozzle 5.

Referring now to FIG. 2, there is shown the toy of the present invention as assembled for commencement of play. The toy includes the landscape or base 1 with the mushroom 11 having the bellows 2 thereon communicating with an aperture 12 which communicates with an air channel 7 therein. The air channel includes an intake valve 13 and an outlet valve 14 below the base of the flower 4. A soft rubber washer 6 is positioned at the base of the flower 4 and receives the nozzle 5 through the washer aperture whereby the washer makes substantially airtight frictional fit with the nozzle 5 and the sides of the balloon 4 rest against the funnel-shaped inside periphery of the flower.

Referring now to FIGS. 2 and 3, the intake valve 13 and the exhaust or outlet valve 14 will be explained in more detail. The exhaust valve as shown in FIGS. 2 and 3 includes a floating rubber disc 8 confined within a cup 9 by a grill 10. The inlet or intake valve 13 includes the same structure as the exhaust valve and utilizes a primed character reference on the corresponding elements. As shown in FIG. 2, the exhaust valve 14 is positioned in the air channel 7 and prevents the return flow of air from the balloon but permits the flow of air into the balloon. The intake valve 13 permits air to flow into the air channel 7 but not out of the air channel 7. This operation is best described with reference to FIGS. 4 and 5. As shown in FIG. 4, and considering exhaust valve 14, when the air pressure in the balloon 4 is greater than the air pressure in the air channel 7, the floating rubber disc 8 will be moved downwardly as shown in FIG. 4 to close off the aperture 15 of the cup 9. Therefore the balloon 4 will remain inflated. When the pressure in the balloon 4 is less than the pressure in the air channel 7, air will pass from the air channel 7 through the aperture 15 and force the floating rubber disc upwardly as shown in FIG. 5 so that the air can move through the aperture 15, around the disc 8 and into the balloon through the nozzle 5 in the balloon. The intake valve 13 will operate in the same manner as described for exhaust valve 14. The intake valve includes floating rubber disc 8′ confined within the cup 9′ by the channel grill 10′. Ambient air from a point external to the valve will enter the air channel 7 as the bellows 2 is expanded by pulling upward thereon since this expansion of the bellows will create a decrease in air pressure within the air channel below ambient air pressure. This will cause the disc 8′ to move upwardly and allow the ambient air to move into the air channel. However, when the air in the air channel is at a presure above the ambient pressure, the disc 8' will move downwardly as shown in FIGS. 2 and 4 to block the aperture 15' and prevent air from escaping from the air channel through the intake valve 13 when the bellows 2 is being compressed.

It can be seen that the pumping or reciprocating action applied to the bellows 2 will cause air to be taken in through the intake valve 13 into the air channel 7 and bellows 2, then be pushed through the exhaust valve into the balloon 4 through the nozzle 5. As the balloon 4 continues to be inflated with more and more air, the sides of the balloon will expand in diameter, thereby exerting an increasing outward force against the inside periphery of the funnel-shaped flower structure 3. When this force exceeds the restraining force of the rubber washer 6 on the nozzle 5 due to the frictional action thereon, the nozzle 5 will be pulled away from the washer 6. As soon as the nozzle 5 is removed from the washer 6, air within the balloon 4 will be ejected through the nozzle and the jet of the escaping air from the nozzle will cause the balloon to fly away.

Referring now to FIG. 6, there is shown a second embodiment of the air passage 7'. The air passage 7' includes chamber 23 with air intake valve 13' therein, flexible tube 22 and chamber 24 with outlet valve 14' therein. The air intake valve 13' is positioned in the sidewall 20 of chamber 23 and a nozzle 21 is formed in the wall of chamber 23 which communicates with flexible tube 22 at one end thereof. The other end of tube 22 communicates with nozzle 25 in the wall of chamber 24 with outlet valve 14' positioned in chamber 24. The valves and other parts of FIG. 6 are identical to those of FIG. 2.

While the toy described above would have inherent utility as a toy itself, it can be seen that the toy can also be utilized as a game wherein each player could be alloted a fixed number of depressions of the bellows, the winner being the child who makes the balloon fly away. Alternatively, the number of depressions of the bellows may be determined by a spinner or roll of a die or dice.

Though the invention has een described with respect to a specific preferred embodiment thereof, many variations and modifications thereof will immediately become apparent to those skilled in the art. It is therefore the intention that the appended claims be interpreted as broadly as possible in view of the prior art to include all such variations and modifications.

What is claimed is:

1. A toy, which comprises, in combination, (a) a body having an outer surface, said body having an airtight air passage therein, (b) an aperture in said air passage, (c) air compression means secured in airtight relation to the said air passage at said aperture, (d) an air intake valve communicating with said air passage, (e) an air outlet valve communicating with said air passage, (f) frictional holding means secured to said body downstream of said outlet valve, (g) inflatable means providing a frictional airtight fit with said holding means and responsive to passage of air through said outlet valve for inflating said inflatable means, and (h) means surrounding at least a portion of said inflatable means and responsive to inflation of said inflatable means for ejecting said inflatable means out of contact with said frictional holding means.

2. A toy as set forth in claim 1 wherein said air compression means is a bellows.

3. A toy as set forth in claim 2 wherein said means providing a frictional airtight fit includes a nozzle.

4. A toy as set forth in claim 3 wherein said frictional holding mans is a resilient washer frictionally holding said nozzle.

5. A toy as set forth in claim 4 wherein said inflatable means is a balloon and said means surrounding at least a portion of said inflatable means is a funnel-shaped means wherein inflation of said balloon forces the sides of said balloon against the funnel-shaped means and forces said nozzle to move out of frictional engagement with said frictional holding means.

6. A toy as set forth in claim 3 wherein said inflatable means is a balloon and said means surrounding at least a portion of said inflatable means is a funnel-shaped means wherein inflation of said balloon forces the sides of said balloon against the funnel-shaped means and forces said nozzle to move out of frictional engagement with said frictional holding means.

7. A toy as set forth in claim 1 wherein said inflatable means providing a frictional air-tight fit includes a nozzle.

8. A toy as set forth in claim 7 wherein said frictional holding means is a resilient washer frictionally holding said nozzle.

9. A toy as set forth in claim 8 wherein said inflatable means is a balloon and said means surrounding at least a portion of said inflatable means is a funnel-shaped means wherein inflation of said balloon forces the sides of said balloon against the funnel-shaped means and forces said nozzle to move out of frictional engagement with said frictional holding mans.

10. A toy as set forth in claim 7 wherein said inflatable means is a balloon and said means surrounding at least a portion of said inflatable means is a funnel-shaped means wherein inflation of said balloon forces the sides of said balloon against the funnel-shaped means and forces said nozzle to move out of frictional engagement with said frictional holding means.

* * * * *